United States Patent [19]

Heynisch

[11] 4,250,430

[45] Feb. 10, 1981

[54] MULTI-STAGE COLLECTOR FOR TRANSIT-TIME TUBES

[75] Inventor: Hinrich Heynisch, Graefelfing, Fed. Rep. of Germany

[73] Assignee: Siemens Aktiengesellschaft, Berlin & Munich, Fed. Rep. of Germany

[21] Appl. No.: 944,155

[22] Filed: Sep. 20, 1978

[30] Foreign Application Priority Data

Sep. 30, 1977 [DE] Fed. Rep. of Germany ..... 274422

[51] Int. Cl.[3] ..... H01J 23/02

[52] U.S. Cl. ..... 315/5.38; 250/489

[58] Field of Search ..... 250/281, 282, 287, 294, 250/306, 396 R, 397, 489, 305; 315/3, 5.38; 313/361

[56] References Cited

U.S. PATENT DOCUMENTS

| | | | |
|---|---|---|---|
| 3,368,102 | 2/1968 | Saharian | 315/5.38 |
| 3,543,079 | 11/1970 | Uno et al. | 250/397 |
| 3,644,778 | 2/1972 | Mihran et al. | 315/5.38 |
| 3,681,600 | 8/1972 | Rigden et al. | 250/305 |
| 3,715,590 | 2/1973 | Auer | 250/287 |
| 3,731,096 | 5/1973 | Carter | 250/305 |
| 3,925,701 | 12/1975 | Wolfram | 315/5.38 |
| 3,970,891 | 7/1976 | Heymisch et al. | 315/5.38 |

*Primary Examiner*—Bruce C. Anderson

*Attorney, Agent, or Firm*—Hill, Van Santen, Steadman, Chiara & Simpson

[57] ABSTRACT

A multi-stage collector for a transit-time tube has a catcher plate with a hollow element extending inwardly therefrom and coaxially aligned with the electron beam of the tube.

8 Claims, 4 Drawing Figures

MULTI-STAGE COLLECTOR FOR TRANSIT-TIME TUBES

BACKGROUND

1. Field of the Invention

The present invention relates to a multi-stage collector for transit-time tubes and in particular traveling wave tubes.

2. The Prior Art

Electron beam catchers are known for transit-time tubes and in particular traveling wave tubes which consist of a plurality of electrodes lying one behind each other in the direction of the beam, the electrodes being maintained at different electrical potentials and adapted to absorb the beam. Such an arrangement is known in the German published Auslegeschrift No. 1,273,703. Such a catcher consists, for example, of a pot-shaped collector electrode and two circular electrodes which are connected together by material which is electrically resistive. The pot-shaped electrode has a catcher plate which is aligned with the electron beam. Electrons which are not deflected to the circular collector electrodes are collected by the catcher plate.

In such a tube, the catcher plate must be able to absorb the heat produced by the energy of the impinging electron beam and dissipate it. It must also be formed so that secondary electrons released when the electron beam strikes the catcher plate are prevented from entering the discharge chamber. The electrical potential of the catcher plate is typically chosen at a value below that of the operating potential of the system components of the amplifying section of the tube such as a delay line, in order to reduce the power loss at the catcher plate. Such an arrangement is illustrated in German Pat. No. 1,221,364.

In the past, a metal point projecting into the collector as a whole and axially aligned with the beam has been used in the last collector stage, and the point is maintained at cathode potential in order to deflect the electrons of the beam away from the axis. This arrangement produces the problem, however, that electrons which are reflected at the tip itself move back into the interaction space and sometimes even travel as far as the cathode, causing a degradation in the high frequency performance of the tube.

SUMMARY OF THE INVENTION

The principal object of the present invention is to improve the deceleration characteristics of a multi-stage collector for a transit-time tube and thereby increase the efficiency of the tube.

In one embodiment of the present invention, this objective is achieved by providing a hollow cylindrical electrode coaxial with the electron beam and mounted to the center of the catcher end plate, with the electrode projecting into the catcher cavity. In operation, the apparatus of the present invention has the desirable characteristic that electrons in the electron beam are deflected to the sides, and secondary electrons released when the beam strikes the cylindrical electrode are trapped within the confines of the cylinder.

In another embodiment of the present invention, the projecting end of the hollow cylindrical electrode which projects into the catcher cavity has a sharp edge.

In a further embodiment, the end of the cylindrical electrode has an oblique end surface.

In a further embodiment, the end of the projecting cylindrical electrode has a wavy surface.

BRIEF DESCRIPTION OF THE DRAWINGS

Reference will now be made to the accompanying drawings, in which.

DESCRIPTION OF THE PREFERRED EMBODIMENTS

Figure 1:
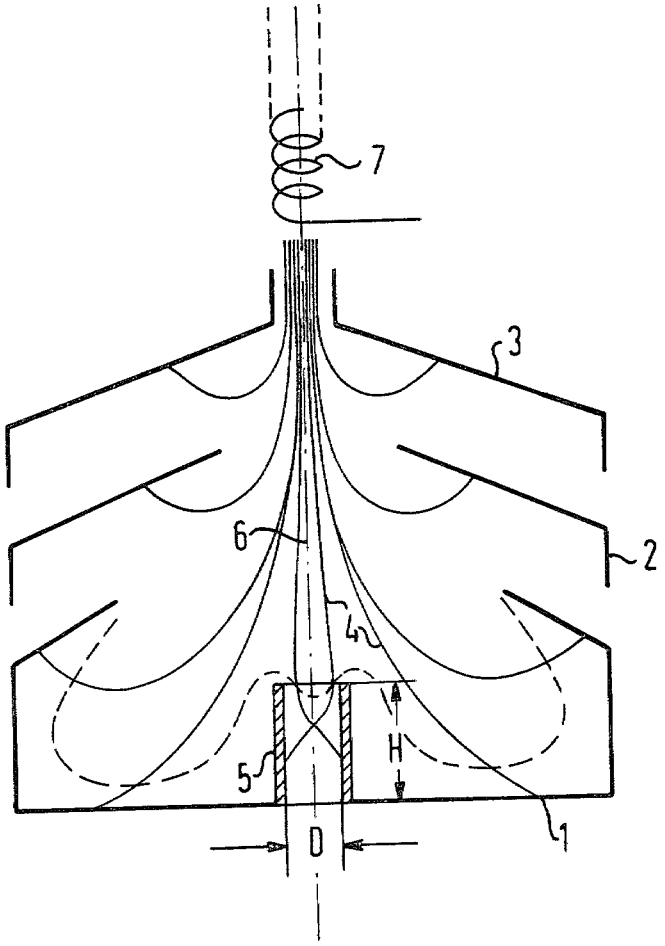
FIG. 1 is a diagrammatic view of a three-stage collector incorporating an illustrative embodiment of the present invention.

FIG. 1 shows a purely schematic form of a multi-stage collector of a traveling wave tube. It will be understood that the portions of the tube not necessary for an understanding of the present invention, such as the electrical leads, have been omitted. FIG. 1 is a cross section taken through the axis of the tube. The collector is provided with three stages consisting of a catcher 1 which functions as a final collector stage, and two circular electrodes 2 and 3. An aperture in each of the electrodes 2 and 3 is aligned with the axis 6 of the tube along which the electron beam moves. The electrodes effectively surround the electron beam. The paths which are taken by several electrons in the beam are illustrated by the lines 4 in FIG. 1.

During operation of the tube, the catcher 1 is preferably at cathode potential, and the electrodes 2 and 3 are at different potentials so that the the electron beam is spread, so that various electrons follow the paths 4. The beam enters the collector area from a delay line which is indicated diagrammatically in FIG. 1 as a spiral 7.

Figure 2:
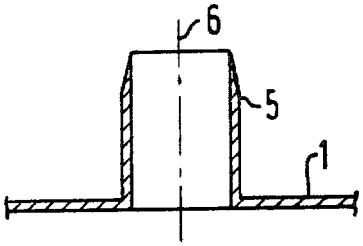
FIGS. 2 to 4 illustrate alternate embodiments of the hollow cylindrical electrode of FIG. 1.
Figure 3:
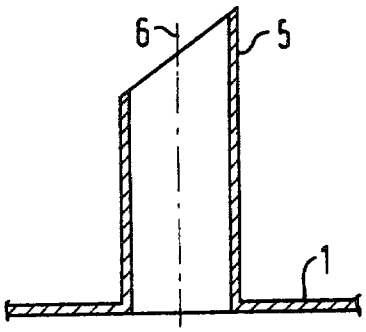
Figure 4:
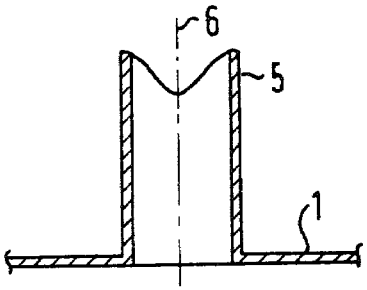

A hollow cylindrical electrode 5 is disposed on the catcher 1 in a position in coaxial alignment with the beam, with its end projecting into the catcher cavity. The height H of the cylindrical electrode 5 is preferably 2 or more times the inside diameter D. Electrons which enter the electrode 5 are deflected to the sides of the cylinder, due to its hollow cylindrical shape, and secondary electrons are trapped within the electrode. Although the interior projecting surface of the electrode may define a plane transverse to the axis as illustrated in FIG. 1, preferably, the interior surface is sharpened as illustrated in FIG. 2, or constructed so as to define a plane which crosses the axis 6 at an oblique angle as illustrated in FIG. 3. The arrangement of FIG. 4 has also been found to be satisfactory, in which the interior edge of the electrode 5 terminates in a wavy fashion, to introduce an asymmetry into the physical structure.

The dashed line in FIG. 1 shows an equal potential line resulting when the catcher plate 1 and the tube electrode 5 are maintained at the cathode potential. The shape of the equal potential surface tends to enhance the operational characteristics of the tube.

When the inside face of the hollow cylindrical electrode 5 is coated with graphite, zirconium, or a similar material, secondary electron emission is further reduced. Alternatively, the entire electrode 5 may be formed of graphite.

It will be appreciated that various modifications and additions may be made in the apparatus of the present invention without departing from the essential features of novelty thereof, which are intended to be defined and secured by the appending claims.

What is claimed is:

1. A multi-stage collector for a transit-time tube such as a traveling wave tube comprising in combination, a hollow catcher element to catch the electron beam, said catcher element having a catcher plate adapted to intercept said electron beam, a plurality of electrodes surrounding said electron beam and spaced apart in an axial direction, said electrodes being adapted to be at different electrical potentials during operation of said tube, and a hollow cylindrical electrode for collecting said electron beam arranged coaxially with the electron beam axis projecting into the catcher cavity, said cylindrical electrode having a surface formed of graphite or zirconium to reduce secondary electron emission.

2. A collector according to claim 1, wherein the ratio of the height of said cylindrical electrode to its diameter is greater than 2.

3. A collector according to claim 1, wherein the end of said cylindrical electrode projecting into said catcher cavity, has a sharp edge.

4. A collector according to claim 1, wherein the end of the cylindrical electrode projecting into said catcher cavity terminates in a plane oblique to the axis of said tube.

5. A collector according to claim 1, wherein the end of said cylindrical electrode projecting into said catcher cavity terminates with a wavy edge.

6. A collector according to claim 1, wherein the cylindrical electrode is formed of graphite.

7. A collector according to claim 1, wherein a surface of said cylindrical electrode is coated with graphite.

8. A collector according to claim 1, wherein a surface of said cylindrical electrode is coated with zirconium.

* * * * *